US007348303B2

(12) United States Patent
Gallotti et al.

(10) Patent No.: US 7,348,303 B2
(45) Date of Patent: Mar. 25, 2008

(54) QUATERNARY AMMONIUM COMPOSITION

(75) Inventors: Manlio Gallotti, Sao Paulo (BR); Patricia Ramos Pereira De Moraes, Sao Paulo (BR); Cássio Queiroz Cavalcante, Sao Paulo (BR)

(73) Assignee: Clariant International, Ltd., Muttenz (CH)

( * ) Notice: Subject to any disclaimer, the term of this patent is extended or adjusted under 35 U.S.C. 154(b) by 0 days.

(21) Appl. No.: 10/537,556

(22) PCT Filed: Nov. 26, 2003

(86) PCT No.: PCT/EP03/13279

§ 371 (c)(1),
(2), (4) Date: Dec. 12, 2005

(87) PCT Pub. No.: WO2004/050605

PCT Pub. Date: Jun. 17, 2004

(65) Prior Publication Data

US 2006/0135389 A1 Jun. 22, 2006

(30) Foreign Application Priority Data

Dec. 4, 2002 (EP) ..... 02027119

(51) Int. Cl.
*C11D 3/00* (2006.01)

(52) U.S. Cl. ..... 510/329; 564/281; 564/282

(58) Field of Classification Search ..... 510/329; 564/281, 282

See application file for complete search history.

(56) References Cited

U.S. PATENT DOCUMENTS

| | | | | |
|---|---|---|---|---|
| 4,675,180 | A * | 6/1987 | Gunter | 424/70.28 |
| 5,053,531 | A * | 10/1991 | Govindan | 562/114 |
| 5,414,124 | A * | 5/1995 | Smith et al. | 564/282 |
| 5,415,812 | A | 5/1995 | Durbut | |
| 5,634,969 | A | 6/1997 | Cody | |
| 5,718,891 | A | 2/1998 | Prat | |
| 5,858,948 | A | 1/1999 | Ghosh | |
| 6,017,874 | A | 1/2000 | Lappas | |
| 6,087,314 | A | 7/2000 | Heinzmann | |
| 2003/0012763 | A1 | 1/2003 | Barinova | |
| 2005/0020473 | A1 | 1/2005 | Gallotti | |

FOREIGN PATENT DOCUMENTS

| | | |
|---|---|---|
| GB | 2317391 | 3/1998 |
| WO | WO 94/07978 | 4/1994 |
| WO | WO 98/13449 | 4/1998 |
| WO | WO 98/13452 | 4/1998 |
| WO | WO 98/20092 | 5/1998 |
| WO | WO 98/35004 | 8/1998 |

OTHER PUBLICATIONS

English Language Abstract of Japanese Patent JP 58 067649, Apr. 22, 1983, Lion AKZO KK.

* cited by examiner

*Primary Examiner*—Yvonne (Bonnie) Eyler
*Assistant Examiner*—Chukwuma O. Nwaonicha
(74) *Attorney, Agent, or Firm*—Richard P. Silverman

(57) ABSTRACT

A quaternary ammonium composition is claimed which essentially consists of
a) a cationic compound with general formula:

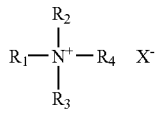

wherein $R_1$ is $C_8$-$C_{22}$-alkyl, $C_8$-$C_{22}$-alkenyl, $C_8$-$C_{22}$-alkylamidopropyl, $C_8$-$C_{22}$-alkenyl-amidopropyl, $C_8$-$C_{22}$-alkyl/alkenyl(poly)alkoxyalkyl, $C_8$-$C_{22}$-alkanoylethyl or $C_8$-$C_{22}$-alkenoylethyl, $R_2$, $R_3$ and $R_4$ are $C_1$—$C_{22}$-alkyl, $C_2$-$C_{22}$-alkenyl or a group of the formula -A-$(OA)_n$-OH, A is —$C_2H_4$— and/or —$C_3H_6$—, n is a number from 0 to 20 and X is an anion, b) water and c) a non-ionic solvent of the general formula R—O-$(AO)_n$H, where R is hydrogen, alkyl or alkenyl containing 8 to 22 carbon atoms, or phenyl, A is $C_2H_4$ and/or $C_3H_6$ and n is a number from 0 to 20, which composition is characterized in that it contains less than 20% by weight of water.

14 Claims, No Drawings

QUATERNARY AMMONIUM COMPOSITION

Use of quaternary ammonium compounds in detergents formulations has been widely used as it improves physical and chemical properties of the mixture.

One of the most used ammonium quaternary are the Hydroxyethyl Quats. They could be classified as a typical cationic surfactant which solubility or hydrophilic characteristics are improved by the presence of a hydroxyl group in its structure. This characteristic makes possible its use in typical anionic formulation in which is stable and shows particular benefits synergetic action on removal of difficult stains like oily and fatty ones from fabrics or other surfaces, also after aging.

It also presents synergistic effect when incorporate with anionics, amphoterics, and/or non-ionics surfactants.

Hydroxyethyl Quats are detergency boosters for use in all laundry detergent powders and liquid for clothes washing in house hold, industrial, and institutional area.

The use of these compounds in HDP formulations improves the fatty-soil and clay-soil removal, the graying inhibition, the enzyme efficiency and the bleach effects. Besides that it reduces interference of surfactant system on the action of dye transfer inhibitor and dye fixing agents.

All these benefits are described in U.S. Pat. No. 5,415,812, WO 97/45513, WO 97/43367, WO 97/42292, WO 97/44419, WO97/12018, WO 98/13448, WO 98/13449, WO 98/13451, WO 98/13452, WO 98/13453, WO 98/17751, WO 98/17754, WO 98/17755, WO 98/17758, WO 98/17759, WO 98/17766, WO98/17767, WO 98/17768, WO 98/17769, WO 98/20092, WO 98/35004.

Hydroxyethyl Quats also provide a sensitive synergic improvement in physical and chemical properties of light duty liquid formulations, as described in WO0188073. In Hard Surface Cleaners the Hydroxyethyl Quats increase the detergency when it is in the presence of anionic surfactants and in Disinfectant Cleaners it presents all benefits as comparable with anionic cleaners but with a special anti-bacteria effect, as described in WO 01/94511.

The up dated technology available to produce this kind of surfactant is based on synthesis in aqueous medium, as the active content is a salt and so it's highly soluble in water. Therefore, it has been commercialized in aqueous solution. However, nowadays the detergent market tends to use raw materials as concentrated as possible, what means with the lowest amount of water possible. In most of the cases the water has to be removed from the final formulation. So, it's a big advantage to the customer buying the cationic compound obtained in a medium that is part of the final product and don't need to be removed. Besides that, using detergents having high concentrations of detersive substances minimize transportation, storage and packaging costs. It also improves handling for the customer.

In this way detergents having big amounts of water constitute a difficulty for detergent industries because it decreases the content of the active substances.

The present invention provides for quaternary ammonium composition essentially consisting of a) a cationic compound with general formula:

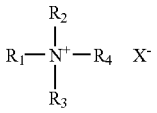

wherein $R_1$ is $C_8$-$C_{22}$-alkyl, $C_8$-$C_{22}$-alkenyl, $C_8$-$C_{22}$-alkylamidopropyl, $C_8$-$C_{22}$-alkenyl-amidopropyl, $C_8$-$C_{22}$-alkyl/alkenyl(poly)alkoxyalkyl, $C_8$-$C_{22}$-alkanoylethyl or $C_8$-$C_{22}$-alkenoylethyl, $R_2$, $R_3$ and $R_4$ are $C_1$-$C_{22}$-alkyl, $C_2$-$C_{22}$-alkenyl or a group of the formula -A-$(OA)_n$-OH, A is —$C_2H_4$— and/or —$C_3H_6$—, n is a number from 0 to 20 and X is an anion, b) water and c) a non-ionic solvent of the general formula R—O-$(AO)_n$H, where R is hydrogen, alkyl or alkenyl containing 8 to 22 carbon atoms, or alkyl-phenyl, A is $C_2H_4$ and/or $C_3H_6$ and n is a number from 0 to 20, when R is alkyl or alkenyl and n is a number from 1 to 20 if R is hydrogen, which composition is characterized in that it contains less than 20% by weight of water.

The quaternary ammonium composition presents preferably 5 to 60% by weight of an active cationic component a), less than 20% of water and preferably 40 to 95% by weight of one or more of the non-ionic solvent. The composition is also characterized for having less than 5% of by products (free amine plus amine chlorohydrate). Addition of some additives to improve product characteristics is also possible.

The compositions as claimed herein are prepared in the following way according to the nature of $R_2$, $R_3$ and $R_4$.

If $R_4$ is an alkyl or alkenyl group an amine of the formula

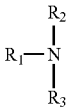

wherein $R_1$, $R_2$ and $R_3$ are as defined above, is quaternized by reacting it with a halo alkyl or halo alkenyl of the formula $R_4$—X wherein X is chlorine or bromine. This reaction is made in the presence of a non-ionic solvent c) as defined above. The reaction time is from 3 to 8 hours and the reaction temperature is from 20 to 100° C. This reaction is done by diluting the starting amine with the non-ionic solvent and then adding the halo alkyl or halo alkenyl compound. It is also possible to first mix the halo alkyl or halo alkenyl compound with the non-ionic solvent and than add the amine.

If a composition is made containing a quaternary compound wherein $R_4$ is a group of the formula -A-$(OA)_n$-OH, the amine of the formula $R_1R_2R_3N$ is treated with an inorganic halo acid such as for example hydrochloric acid. This reaction is done in the presence of the non-ionic solvent as defined above. The reaction normally is completed after 0.5 to 2 hour at a temperature of 20 to 100° C. In a second step the ammonium salt obtained in the first step is reacted with ethylene oxide and/or propylene oxide at 40 to 100° C.

Normally this step takes 3-8 hours, depending on the amount of starting material and the equipment where the reaction is performance. It's important to emphasize that the component or component used as reactional medium must be inert, what means they cannot react with ethylene oxide or propylene oxide under the theses conditions.

As cationic surfactants there may be used the following ones, alkyldimethyl-hydroxyethyl-ammonium, alkyl-dimethyl(poly)alkoxyalkyl-ammonium, alkyltrimethyl-ammonium, dialkyldimethyl-ammonium, dialkyl-methyl(poly) alkoxyalkyl-ammonium, alkyl-di(poly)-alkoxyalkyl-methyl-ammonium, dialkyl-di(poly)alkoxy-ammonium, alkyl-tri(poly)-alkoxy-ammonium, alkylamidopropyl-trimethyl-ammonium, alkylamidopropyl-dimethyl(poly)-alkoxyalkyl-ammonium, alkoxyethyl-trimethyl-ammonium. Instead of alkyl these ammonium compounds may also have alkenyl groups or mixtures of both. The alkyl as well as the alkenyl groups may contain 8 to 22 carbon atoms. They may be linear or branched. (Poly)-alkoxyalkyl means a group of the formula -A-$(OA)_n$-OH wherein A is ethylene or propylene group or a mixture of both and n is a number of from 0 to 20. Preferably n is zero and A is ethylene that means those compounds and preferred which contain a hydroxyethyl group. Most preferred ammonium compounds are $C_8$-$C_{22}$-alkyl- or alkenyl-dimethyl-hydroxyethyl-ammonium compounds. All mentioned ammonium compounds might contain any kind of anion; the preferred ones are chloride, bromide, acetate, lactate, sulphate or methosulphate.

As solvent there may be used the following ones, an alcohol or an ethoxylated alcohol with general formula R—O-$(AO)_n$H, where R is alkyl or alkenyl group containing 8 to 22 carbon atoms, A is $C_2H_4$ and/or $C_3H_6$ and n is a number from 0 to 20, a polymer or a block co-polymer with general formula -A-$(OA)_n$-OH wherein A is ethylene and/or propylene group or a mixture of both and n is a number of from 0 to 20, nonylphenol or ethoxylated nonylphenol with general formula $C_9H_{19}$-phenyl-O-$(AO)_n$H, where A is $C_2H_4$ and/or $C_3H_6$ or a mixture of the compounds above.

EXAMPLE 1

To a 3 liter four necked round bottom flask equipped with stirrer, thermometer, reflux condenser and dropping funnel were charged 1460 g of $C_{12}/C_{14}/C_{16}$ alcohol polyglycol 7 EO and 324 g of dimethyl alkyl ($C_{12}/C_{14}/C_{16}$) amine. Under stirring were added 150 g of hydrochloric acid 34% in fifteen minutes. Due the exothermicity the temperature reach 70° C. During the addition the temperature was kept between 60-70° C. The system was let under stirring and at 70-75° C. for two more hours. We got approx. 1930 g of an intermediate product with the following characteristics:

Appearance (25° C.): Clear slightly yellow liquid

Free amine: 0.19%

Amine Chlorohydrate: 19.0%

Water (KF): 5.4%

To a 2 liter high-pressure reactor equipped with stirrer, thermometer, nitrogen feed and pressured dropping funnel were charged 969 g of the intermediate (Amine Chlorohydrate). The system was in inert mode and then heated to 65-70° C. Then 36.7 g (0.75 mols) of ethylene oxide were added in 4 hours, keeping the temperature at 75-80° C. and the pressure between 0.5 and 3.0 Bar. We kept the system for 1 more hour stirring at 75-80° C. We got approx. 1005 g of final product with the following characteristics:

Appearance (25° C.): Clear slightly yellow liquid

Free amine+amine chlorohydrate: 0.54%

Active content: 19.5%

Water (KF): 4.9%

To decrease even more the amount of water the product was distilled under vacuum and at 70-80° C. for 3 hour and we got a product with the following characteristic:

Appearance (25° C.): Clear slightly yellow liquid

Free amine+amine chlorohydrate: 0.55%

Active content: 19.8%

Water (KF): 1.7%

Keeping distilling for two more hours at the same conditions we got the following product:

Appearance (25° C.): Cloud white liquid

Free amine+amine chlorohydrate: 0.60%

Active content: 20.3%

Water (KF): 0.46%

Summarizing with this process we got tree different possible final product:

| Characteristics | Example 1.1 | Example 1.2 | Example 1.3 |
|---|---|---|---|
| Appearance (25° C.) | Clear slightly yellow liquid | Clear slightly yellow liquid | Cloud white liquid |
| Free Amine + Amine Chlorohydrate (%) | 0.19 | 0.55 | 0.60 |
| Cationic Content (%) | 19.5 | 19.8 | 20.3 |
| Water (KF) (%) | 5.4 | 1.7 | 0.46 |

EXAMPLE 2

To a 3 liter four necked round bottom flask equipped with stirrer, thermometer, reflux condenser and dropping funnel were charged 1650 g of $C_{12}/C_{14}/C_{16}$ alcohol polyglycol 7 EO and 905 g of dimethyl alkyl ($C_{12}/C_{14}/C_{16}$) amine. Under stirring were added 419 g of hydrochloric acid 34% in fifteen minutes. Due the exothermicity the temperature reach 70° C. During the addition the temperature was kept between 60-70° C. The system was let under stirring and at 70-75° C. for two more hours. We got approx. 2974 g of an intermediate product with the following characteristics:

Appearance (25° C.): Slightly cloud and yellow liquid with shows phase separation after some days.

Free amine: 0.13%

Amine Chlorohydrate: 34.6%

Water: 10.8%

To a 2 liter high-pressure reactor equipped with stirrer, thermometer, nitrogen feed and pressured dropping funnel were charged 1120 g of the intermediate (Amine Chlorohydrate). The system was in inert mode and then heated to 65-70° C. Then 73.7 g (1.68 mols) of ethylene oxide were added in 4 hours, keeping the temperature at 75-80° C. and the pressure between 0.5 and 3.0 Bar. We kept the system for 1 more hour stirring at 75-80° C. We got approx. 1005 g of final product with the following characteristics:

Appearance (25° C.): Slightly cloud and yellow liquid with shows phase separation after some days. The product can be easily homogenized by stirring at a temperature between 25 and 50° C.

Free amine+amine chlorohydrate: 0.42%

Active content: 37.2%

Water (KF): 9.6%

To decrease even more the amount of water the product was distilled under vacuum and at 70-80° C. for 3 hour and we got a product with the following characteristic:

Appearance (25° C.): Slightly cloud and yellow liquid with shows phase separation after some days. The product can be easily homogenized by stirring at a temperature between 25 and 50° C.

Free amine+amine chlorohydrate: 0.4%

Active content: 39.7%

Water (KF): 4.6%

EXAMPLE 3

To a 3 liter four necked round bottom flask equipped with stirrer, thermometer, reflux condenser and dropping funnel were charged 1320 g of $C_{12}/C_{14}/C_{16}$ alcohol polyglycol 7 EO and 456 g of dimethyl alkyl ($C_{12}/C_{14}/C_{16}$) amine. Under stirring were added 211 g of hydrochloric acid 34% in fifteen minutes. Due the exothermicity the temperature reach 70° C. During the addition the temperature was kept between 60-70° C. The system was let under stirring and at 70-75° C. for two more hours. We got approx. 1930 g of an intermediate product with the following characteristics:

Appearance (25° C.): Slightly cloud and yellow liquid with shows phase separation after some days.

Free amine: 0.10%

Amine Chlorohydrate: 26.4%

Water: 8.6%

To a 2 liter high-pressure reactor equipped with stirrer, thermometer, nitrogen feed and pressured dropping funnel were charged 987 g of the intermediate (Amine Chlorohydrate). The system was in inert mode then heated to 65-70° C. Then 50.3 g (1.14 mols) of ethylene oxide were added in 4 hours, keeping the temperature at 75-80° C. and the pressure between 0.5 and 3.0 Bar. We kept the system for 1 more hour stirring at 75-80° C. We got approx. 1005 g of final product with the following characteristics:

Appearance (25° C.): Slightly cloud and yellow-liquid with shows phase separation after some days. The product can be easily homogenized by stirring at a temperature between 25 and 50° C.

Free amine+amine chlorohydrate: 0.37%

Active content: 28.4%

Water (KF): 7.5%

To decrease even more the amount of water the product was distilled under vacuum and at 70-80° C. for 3 hour and we got a product with the following characteristic:

Appearance (25° C.): Slightly cloud and yellow liquid with shows phase separation after some days. The product can be easily homogenized by stirring at a temperature between 25 and 50° C.

Free amine+amine chlorohydrate: 0.29%

Active content: 30.1%

Water (KF): 4.3%

The invention claimed is:

1. A quaternary ammonium composition consisting essentially of a) a cationic compound with general formula:

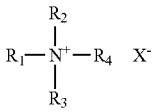

wherein $R_1$ is $C_8$-$C_{22}$-alkyl, $C_8$-$C_{22}$-alkenyl, $C_8$-$C_{22}$-alkylamidopropyl, $C_8$-$C_{22}$-alkenyl-amiodopropyl, $C_8$-$C_{22}$-alkyl/alkeny(poly)alkoxyalkyl, $C_8$-$C_{22}$-alkanoylethyl or $C_8$-$C_{22}$-alkenoylethyl, $R_2$ and $R_3$ are $C_1$-$C_{22}$-alkyl, $C_2$-$C_{22}$-alkenyl and $R_4$ is a group of the formula -A-$(OA)_n$-OH, A is —$C_2H_4$— and/or —$C_3H_8$—, n is a number from 0 to 20 and X is an anion, b) less than 20% by weight of water based on said composition and c) a non-ionic solvent selected from the group consisting of an alcohol or an ethoxylated alcohol with the general formula R—O-$(AO)_n$ H, where R is alkyl or alkenyl group containing 8 to 22 carbon atoms, A is $C_2H_4$ or $C_3H_6$ and mixtures thereof, and n is a number from 0 to 20, nonylphenol or ethoxylated nonylphenol with the general formula $C_8H_{18}$-phenyl-O-$(AO)_n$H, where A and n are as defined above, and mixtures thereof.

2. The composition of claim 1, which contains 5 to 60% by weight of the cationic compound a).

3. The composition of claim 1, wherein the cationic compound a) is an $C_8$-$C_{22}$-alkyl or $C_8$-$C_{22}$-akenyl-dimethylhydroxyethyl ammonium.

4. The composition of claim 1, which has 40 to 95% by weight of the non-ionic solvent c).

5. The composition of claim 1, which has less than 5% of by-products.

6. The composition of claim 1, which the non-ionic solvent is selected from the group consisting of an ethoxylated fatty alcohol, a fatty alcohol, a polyethylene glycol, a polypropylene glycol, a block co-polymer of ethylene and propylene, a nonylphenol, an ethoxylated nonylphenol, and a mixture thereof.

7. A process for preparing a quaternary ammonium composition consisting essentially of a) a cationic compound with general formula:

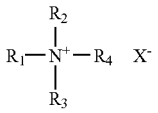

wherein $R_1$ is $C_8$-$C_{22}$-alkyl, $C_8$-$C_{22}$-alkenyl, $C_8$-$C_{22}$-alkylamidopropyl, $C_8$-$C_{22}$-alkenyl-amidopropyl, $C_8$-$C_{22}$-alkyl/alkenyl(poly)alkoxyalkyl, $C_8$-$C_{22}$-alkanoylethyl or $C_8$-$C_{22}$-alkenoylethyl, $R_2$ and $R_3$ $C_1$-$C_{22}$-alkyl, $C_2$-$C_{22}$-alkenyl, $R_4$ is a group of the formula -A-$(OA)_n$-OH wherein A is —$C_2H_4$— or —$C_3H_8$—, or a mixture thereof, n is a number from 0 to 20 and X is an anion, b) less than 20% by weight of water based on said composition and c) a non-ionic solvent selected from the group consisting of an alcohol or an ethoxylated alcohol with the general formula R—O-$(AO)_n$H, where R is alkyl or alkenyl group containing 8 to 22 carbon atoms, A is $C_2H_4$ or $C_3H_8$ and mixtures thereof, and n is a number from 0 to 20, nonylphenol or ethoxylated nonylphenol with the general formula $C_9H_{19}$-phenyl-O-$(AO)_n$H, where A and n are as defined above, and mixtures thereof, said process comprising:

reacting an amine of the formula

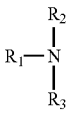

wherein $R_1$ is $C_8$-$C_{22}$-alkyl, $C_8$-$C_{22}$-alkenyl, $C_8$-$C_{22}$-alkylamidopropyl, $C_8$-$C_{22}$-alkenyl-amidopropyl, $C_8$-$C_{22}$-alkyl/alkenyl(poly)alkoxyalkyl, $C_8$-$C_{22}$-alkanoylethyl or $C_8$-$C_{22}$-alkenoylethyl, $R_2$ and $R_3$ are $C_1$-$C_{22}$-alkyl, $C_2$-$C_{22}$-alkenyl or a group of the formula -A-$(OA)_n$—OH, wherein A is —$C_2H_4$— or —$C_3H_6$—, or a mixture thereof, and n is a number from 0 to 20 with an inorganic monohalo acid, and further reacting the ammonium salt thus obtained with ethylene oxide or propylene oxide or a mixture thereof to provide said quaternary ammonium composition.

8. The process of claim 7, wherein the amine is $C_8$-$C_{22}$-alkyl or $C_8$-$C_{22}$-alkenyl-dimethyl amine, or mixtures thereof.

9. The process of claim 7, wherein the monohalo acid is aqueous, hydrochloric acid.

10. The process of claim 7, wherein the ammonium salt is reacted with ethylene oxide.

11. The process of claim 7, wherein the non ionic solvent is a $C_{12}/C_{14}/C_{16}$ alcohol polyglycol having 7 EO units.

12. The process of claim 7, wherein the first step is proceed in a temperature between 20 and 100° C.

13. The process of claim 7, wherein the second step is proceeded in a temperature between 40 and 100° C.

14. The process of claim 7, wherein the amine is $C_8$-$C_{22}$-alkyl or $C_8$-$C_{22}$-alkenyl-dimethyl amine, or mixtures thereof.

* * * * *